United States Patent [19]

DuBois

[11] 4,142,126

[45] Feb. 27, 1979

[54] VACUUM FLUORESCENT DISPLAY HAVING UNIFORM CHARACTER BRIGHTNESS

[75] Inventor: Richard DuBois, North Caldwell, N.J.

[73] Assignee: Wagner Electric Corporation, Parsippany, N.J.

[21] Appl. No.: 883,692

[22] Filed: Mar. 6, 1978

[51] Int. Cl.[2] ..... H01J 5/16; H01J 63/02; H01J 63/06

[52] U.S. Cl. ..... 313/497; 313/112; 313/349

[58] Field of Search ..... 313/496, 497, 112, 349

[56] References Cited

U.S. PATENT DOCUMENTS

| | | | |
|---|---|---|---|
| 3,688,147 | 8/1972 | Raago | 313/496 |
| 4,045,704 | 8/1977 | Kishino et al. | 313/497 |

*Primary Examiner*—Palmer C. Demeo

*Attorney, Agent, or Firm*—Eyre, Mann, Lucas & Just

[57] ABSTRACT

An optical attenuator varying in optical transmission in a systematic fashion, compensates for non-uniform illumination of vacuum fluorescent characters due to filament voltage drop.

24 Claims, 6 Drawing Figures

VACUUM FLUORESCENT DISPLAY HAVING UNIFORM CHARACTER BRIGHTNESS

BACKGROUND OF THE INVENTION

Vacuum fluroescent devices are those in which phosphor coated anode segments are bombarded with low velocity electrons from a thermionically heated filament all contained within an evacuated envelope. The electrons are accelerated from the filament to the anodes by a small electric potential applied therebetween. Electric potentials on the order of a few volts to a few tens of volts are typically employed.

For reasons of economy, it is desired to use directly heated filaments rather than indirectly heated filaments. The voltage drop from one end of the filament to the other causes a difference in accelerating potential between the filament and the anodes from end to end of the filament. In multidigit vacuum fluorescent devices, a perceptible variation in digit brightness is seen due to the difference in potential applied between the filament and the anodes from end to end due to the filament drop.

U.S. Pat. No. 4,045,704 attempts to solve the problem of varying brightness by interposing control grids at varying spacings between the filament and the anodes. By placing the grids closer to the filament at the high-potential end of the filament and progressively further away towards the low-potential end, substantially uniform brightness of the phosphor is achieved.

In U.S. Pat. No. 4,049,993 a similar benefit is achieved by the installation of a filament which slopes downward from one end to the other thus being closer to the grids and/or anode at the positively charged end of the filament than at the negatively charged end. This achieves a uniform electric field between the filament and the respective anode segments along the length of the filament to achieve substantially uniform electron bombardment velocity. This patent also proposes combining varying grid heights with the sloping filament to further improve the brightness uniformity.

Each of the structures recited in the preceding requires special precision treatment of the internal structure of the vacuum fluorescent display device.

DETAILED DESCRIPTION OF THE PREFERRED EMBODIMENT

Figure 1:
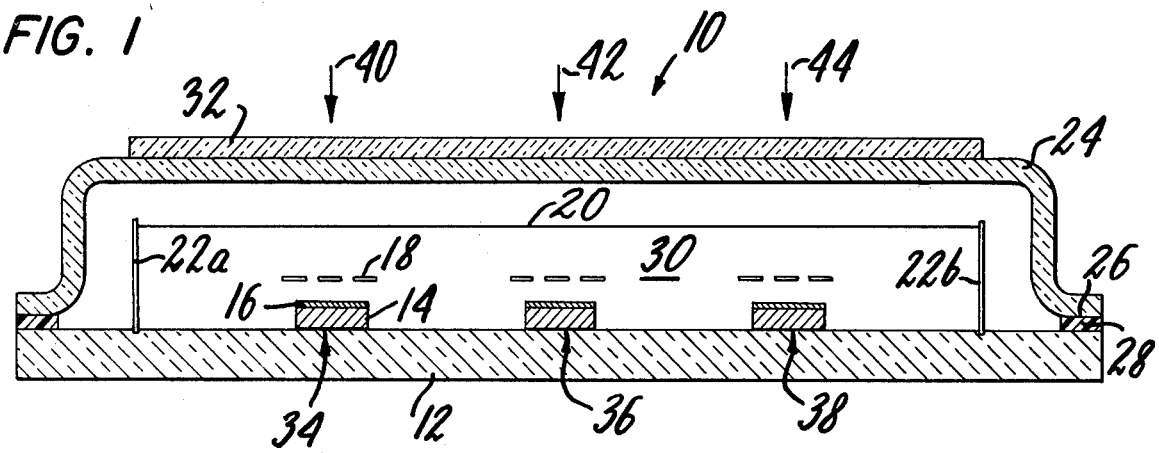
FIG. 1 shows a cross sectional view of a vacuum fluorescent device according to the present invention.

Referring to FIG. 1, there is shown generally at 10 a vacuum fluorescent display device according to the present invention. An insulating substrate 12 has affixed thereon a plurality of conductive anode segments 14 having a coating 16 thereon phosphor material capable of being excited into optical emission by the impingement thereon of electrons.

Each anode 14 shown is part of a pattern of anodes which may be selectively energized to form an illuminated character such as letters or numerals. All anode segments 14 of a particular digit are aligned below a foraminous grid 18 which controls the illumination of all energized anode segments in its aligned character.

A filament 20 is suspended between filament supports *22a, 22b* spanning the entire assembly of anodes 14 and grids 18. The filament 20 may be made up of one or more parallel resistance wires preferably of a material especially adapted to the emission of electrons at low temperature. For example, the filament 20 may be made of thoriated tungsten which is capable of emitting electrons at filament temperatures as cool as dull red. Besides providing support, the filament supports *22a, 22b* may also provide electrical connection to the filament 20.

Electrical connection to all of the elements is accomplished by means well known in the art and are thus not shown.

A cover plate 24, suitably of transparent material such as glass is hermetically sealed to the substrate 12 at a sealing flange 26 using a low temperature frit 28.The volume 30 between the cover plate 24 and the substrate 12 is evacuated and gettered by means well known in the art.

An optical filter 32 is positioned in the line of sight between the viewing location, above the display device 10 as shown in FIG. 1, and the anodes 14. The optical filter 32 may have contrast enhancement properties as disclosed in U.S. Pat. No. 3,682,531. The present invention is not limited to placement of the optical filter external to the cover plate 24. An optical filter 32 within the enclosure is equally within the scope of this invention.

For the discussion which follows, it is assumed that the vacuum display device 10 has 3 sets of characters 34, 36 and 38, viewable along lines of sight 40, 42 and 44 respectively. In addition, it is assumed that character 38 is the brightest and that characters 36 and 34 are progressively less bright than character 36 due to the voltage drop along the filament 20 from filament support *22b* to filament support *22a*. Assigning an arbitrary relative brightness of 1 to the brightest character 38, relative brightness of the other two characters 36 and 34 can then be determined. For example, the relative brightness of character 36 might be 0.75 and that of character 34 might be 0.5. This means that character 36 is three quarters as bright as character 38 and that character 34 is half as bright as character 38.

Figure 2:
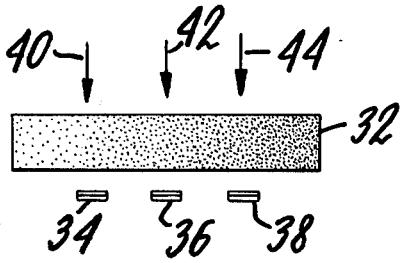
FIG. 2 shows a simplified drawing including an optical filter according to the present invention.

Referring now to FIG. 2 the optical transmission of the optical filter 32 is made to vary from one end to the other by means well known in the art, being least transmissive along the line of sight 44 to the brightest character 38 and most transmissive along the line of sight 40 to the least bright character 34. If the transmission of the filter is related to substantially the inverse of the relative brightness of the characters, the light transmitted to the viewer along lines of sight 40–44 will be relative uniform.

The optical transmission is preferably governed by the relationship:

$$T \simeq \frac{a}{B}$$

Where:

T = optical filter transmission along line of sight

B = segment relative brightness in line of sight $\alpha$ = a constant less than 1.

For example, the following tabulation shows relative brightnesses of 1, 0.75 and 0.5 and filter transmissions along lines of sight 44, 42 and 40 respectively of 0.4, 0.53 and 0.8 also respectively. The light transmitted through an optical filter such as optical filter 32 is equal to the brightness of the source multiplied by the filter transmission. Thus, for the values given in the table, the brightness of all characters is approximately 0.4 times the relative brightness of the unfiltered relative brightness of brightest character 38. This relatively minor reduction in the brightness of the brightest character is relatively insignificant in vacuum fluorescent devices in which the potential for very bright characters is readily realized.

TABLE

| Character | Relative Brightness | Filter Transmission | Light Transmitted |
|---|---|---|---|
| 38 | 1 | 0.4 | 0.4 |
| 36 | 0.75 | 0.53 | 0.4 |
| 34 | 0.5 | 0.8 | 0.4 |

It is also possible to purposefully cause nonuniform apparent brightness of the characters 34–38. It may be desirable, for example, to have character 34 very bright compared to characters 36 and 38. By reducing the filter transmission over characters 36 and 38, and/or increasing the filter transmission over character 34, a wide range of relative apparent brightness can be achieved.

Figure 3:
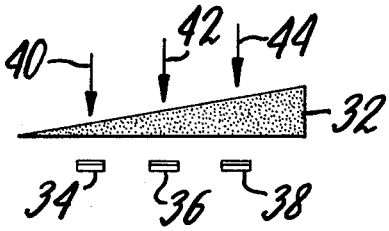
FIG. 3 shows an optical filter having variable thickness.

The optical filter 32 shown in FIG. 3 accomplishes substantially the same result as the variable density filter of FIG. 2 by using a variable thickness of a material having constant optical density. The fraction of light transmitted through an optical filter is equal to $$s = e^{-rx} \quad (1)$$

Where:

s = fractional transmission e = base of natural logarithms r = index of transmission x = thickness of filter Note that as thickness increases, the fractional transmission decreases. The wedge-shaped optical filter 32 in FIG. 3 may be made to exhibit the same transmission characteristics along its length as shown in the table. In which case, the apparent brightness of the characters 34, 36 and 38 viewed along lines of sight 40, 42 and 44 respectively will be approximately uniform.

Figure 4:
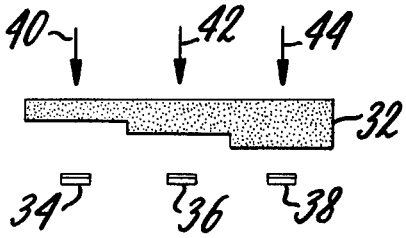
FIG. 4 shows an optical filter having a stepped thickness.

FIG. 4 shows a third embodiment of the optical filter 32. This embodiment also employs a constant density filter material but varies the filter thickness in steps. The thickness of the steps produces optical transmission required along lines of sight 40, 42 and 44 to achieve uniform character brightness.

Figure 5:
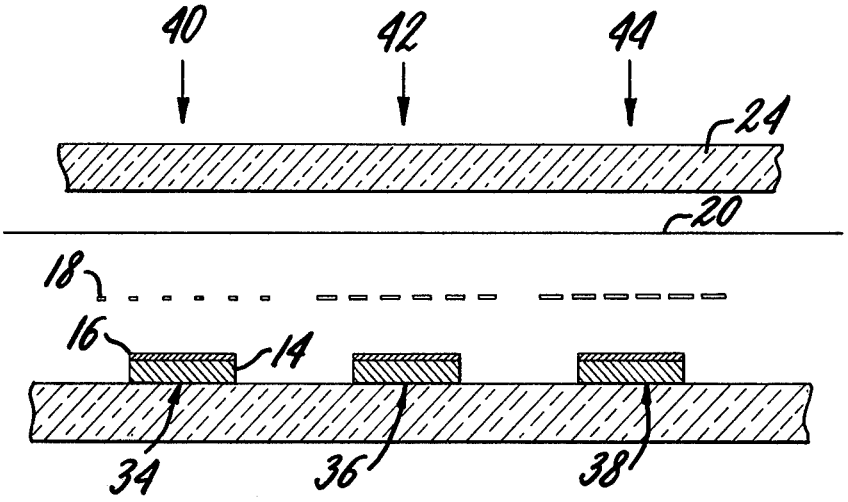
FIG. 5 shows optical filtering being accomplished by varied openness of grids within the enclosure between the filament and the anode segments.

FIG. 5 shows the use of grids 18 having variable ratios of openings located between the filament 20 and the characters 34, 36 and 38. The grid 18 above least bright character 34 has very fine metal strands defining relatively large openings. The grid 18 or foraminous screen over the brightest character 38 has relatively small openings within relatively thick strands thereby reducing the apparent brightness of the character 38. The grid 18 over the intermediate character 36 has an intermediate openness. Openness is defined as the fraction of the grid 18 area which is occupied by openings.

The openness of the grids also interacts with the stream of electrons from the filament 20 toward the characters 34, 36 and 38. The reduced openness of the grid 18 over brightest character 38 may reduce the number and/or velocity of electrons striking the phosphor and thus also reduce the brightness with which the phosphor on character 38 glows. Consequently, the openness of the grids 18 are not the sole determinant of optical brightness seen along lines of sight 40, 42 and 44. Instead, both the occlusion of the glowing phosphor 16 by the grids 18 as well as the modification of phosphor 16 brightness by the grids 18 must be accounted for in determining the openness of the grids 18 to achieve uniform apparent character brightness.

The grids 18 may be individually or commonly connected to a voltage source for the purpose of controlling the flow of electrons to the anode segments, for multiplexing, for electrostatic shielding or for combinations thereof. When the grids 18 are in the electron path between the filament 20 and the anodes 14, the presence of the voltage on them interacts with the electron flow to modify either the electron density or electron energy striking the anode and thus vary the brightness of the glow. The grid 18 openness is adjusted to compensate for this effect to yield uniform character brightness along lines of sight 40, 42 and 44. This relationship is readily determined without experimentation by one skilled in the art.

Figure 6:
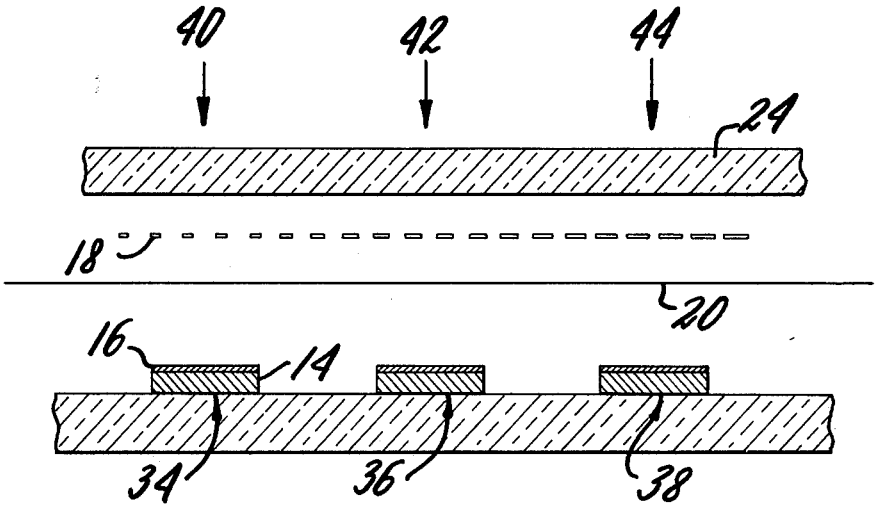
FIG. 6 shows optical filtering being accomplished by varied openness of grids within the enclosure between the cover plate and the filament.

Referring now to FIG. 6, the grid 18 is located between the cover 24 and the filament 20. The grid 18 may be in a single piece having varying openness from end to end, or alternatively, may be in discrete parts. The grid 18 may be connected to a voltage source (not shown) by well known means. The grid or grids 18 may be used as an electrostatic shield, electrostatic lens or other useful function in the device as well as performing optical filtering. The size of the openings in a grid 18 positioned above the filament 20 as shown in FIG. 6 will have little or no interference with the electron density or electron energy striking the characters 34, 36 and 38. Consequently, no adjustment in openness is required to counteract such interference. The grid 18 need not be located inside the enclosure 24, but instead may be located outside the enclosure occupying the position of the optical filter 32 shown in FIG. 1.

It will be understood that the claims are intended to cover all changes and modifications of the preferred embodiments to the invention, herein chosen for the purpose of illustration which do not constitute departures from the spirit and scope of the invention.

What is claimed is:

1. In a vacuum fluorescent display device of the type having a plurality of phosphor-coated anode segments forming a plurality of characters disposed in a plane and a thermionic filament disposed parallel to said plane all located within an evacuated enclosure having a transparent wall for viewing said characters, said filament being directly heated by passing electricity therethrough, said filament being used in common by said plurality of characters to provide electrons for the excitement of the phosphor coating on selected ones thereof to form illuminated characters, and wherein the voltage drop along the filament causes a variation in the electron voltage of the electrons striking said phosphor-coated anode segments and consequently causing the glow of some anode segments to be brighter than others, the improvement comprising:

(a) a filter in the line of sight between said plurality of phosphor-coated anode segments and the viewer;

(b) the optical transmission of said filter being less in the line of sight to the brighter of said anode segments than to the less bright anode segments; and (c) the transmission of said filter along the lines of sight to at least two of said anode segments varying according to $$T \simeq \frac{\alpha}{B}$$

Where:

T = optical transmission

B = relative brightness of anode segment $\alpha$ = constant factor less than 1

$$\text{and } \frac{\alpha}{B} \leqq 1$$

whereby the apparent brightness of said anode segments is substantially uniform.

2. The display device recited in claim 1 further comprising said filter being an optical filter having uniform length of optical path and variable transmission.

3. The display device recited in claim 1 further comprising said filter having a variable optical path length therethrough.

4. The display device recited in claim 3 wherein said filter is wedge shaped.

5. The display device recited in claim 3 wherein said filter is stepped.

6. The display device recited in claim 1 wherein said filter is a foraminous screen having varying openness.

7. The display device recited in claim 6 further comprising:

(a) the openness of said foraminous screen interacting with the electron flow to change the brightness with which said anode segments glow; and (b) the openness of said foraminous screen being effective to compensate for the brightness difference of said anode segments due to filament voltage drop and for brightness difference due to the interaction of said foraminous screen with the electron flow.

8. The display device recited in claim 6 wherein said foraminous screen is located between said filament and said anode segments.

9. The display device recited in claim 8 further comprising:

(a) said foraminous screen having means for connection to a voltage source whereby a voltage is applied to said foraminous screen;

(b) the openness of said foraminous screen and the voltage thereon interacting with the electron flow therethrough to change the electron flow characteristics; and (c) the openness of said foraminous screen being effective to compensate for the brightness difference of said anode segments due to filament voltage drop and for brightness difference due to the interaction of said foraminous screen with the electron flow.

10. The display device recited in claim 6 wherein said foraminous screen is interposed in the line of sight to said filament.

11. The display device recited in claim 10 wherein said foraminous screen is disposed within said evacuated enclosure between said transparent wall and said filament.

12. A vacuum fluorescent display device comprising:

(a) an evacuated enclosure;

(b) a plurality of phosphor-coated anode segments forming a plurality of characters within said enclosure;

(c) a transparent wall in said enclosure for viewing said characters along lines of sight;

(d) at least one cathode disposed over said plurality of segments;

(e) said cathode being electrically heatable to provide electrons for the excitement of the phosphor coating on selected ones of said anode segments to form selected illuminated characters;

(f) at least one optical filter in the line of said sight between at least one of said characters and the viewer;

(g) the optical transmission of said filter in the line of sight to at least one of saic characters being different from the optical transmission to at least one other thereof whereby the apparent brightness of at least two of said characters relative to each other is different than the relative brightness of the glowing phosphor on said at least two characters.

13. Apparatus recited in claim 12 further comprising said anode segments being disposed in a plane.

14. Apparatus recited in claim 12 further comprising:

(a) an insulating substrate forming at least part of said evacuated enclosure opposite said transparent wall; and (b) said anode segment being disposed on said substrate.

15. Apparatus recited in claim 13 wherein said at least one cathode is disposed parallel to said plane.

16. Apparatus recited in claim 15 further comprising:

(a) said cathode being a directly heated filament;

(b) means for supplying direct current to said filament;

(c) said at least one filament being used in common by said plurality of characters; and (d) the optical transmission of said filter along the lines of sight to at least two of said anode segments varying according to:

$$T \simeq \frac{\alpha}{B}$$

Where:

T = optical transmission

B = relative brightness of anode segment $\alpha$ = constant factor less than 1

$$\text{and } \frac{\alpha}{B} \leqq 1$$

17. Apparatus recited in claim 12 wherein said optical filter has uniform length of optical path along the lines of sight to said at least two characters.

18. Apparatus recited in claim 12 wherein said optical filter is wedge shaped.

19. Apparatus recited in claim 12 wherein said optical filter is stepped.

20. Apparatus recited in claim 12 further comprising said optical filter being a foraminous screen having varying openness.

21. Apparatus recited in claim 20 further comprising:

(a) said foraminous screen being located between said cathode and said characters, whereby the transmission of electrons to said characters is interfered with and said characters are illuminated with brightness different than would be the case without the presence of the foraminous screen; and (b) the openness of said foraminous screen being effective to adjust the apparent brightness of said characters including the compensation for the difference in brightness due to the interference of said foraminous screen with the electron flow.

22. Apparatus recited in claim 12 wherein said at least one optical filter is inside said evacuated enclosure.

23. Apparatus recited in claim 12 wherein said optical filter is outside said optical enclosure.

24. A vacuum fluorescent display device comprising:

(a) a planar insulating substrate;

(b) a plurality of phosphor-coated anode segments disposed on said substrate forming a plurality of characters;

(c) at least one directly heated filament cathode for heating with direct current disposed above and parallel to said characters;

(d) a concave cover plate sealed to said substrate over said characters and cathode and forming with said substrate sealed enclosure;

(e) said sealed enclosure being evacuated;

(f) means for supplying voltages to selected ones of said anode segments whereby selected patterns of illuminated characters are formed;

(g) said cover plate being transparent for viewing said selected patterns along lines of sight to said characters; and (h) an optical filter in the line of sight to at least one character;

(i) said optical filter having an optical transmission which adjusts the apparent brightness of said at least one character to be substantially equal to the apparent brightness of at least one other character.

* * * * *